US007171766B2

(12) United States Patent
Bouche et al.

(10) Patent No.: US 7,171,766 B2
(45) Date of Patent: Feb. 6, 2007

(54) ANKLE AND FOOT STABILIZATION SUPPORT

(76) Inventors: Richard T. Bouche, 3606 219th SW., Brier, WA (US) 98036; Donald C. Labourr, 21802 37th Pl. W., Brier, WA (US) 98036

( * ) Notice: Subject to any disclaimer, the term of this patent is extended or adjusted under 35 U.S.C. 154(b) by 211 days.

(21) Appl. No.: 10/799,449

(22) Filed: Mar. 12, 2004

(65) Prior Publication Data

US 2005/0198869 A1 Sep. 15, 2005

(51) Int. Cl.
*A61F 5/00* (2006.01)

(52) U.S. Cl. ..... 36/89; 602/27; 602/65

(58) Field of Classification Search ..... 36/88, 36/89; 602/27, 28, 65
See application file for complete search history.

(56) References Cited

U.S. PATENT DOCUMENTS

| | | | | | |
|---|---|---|---|---|---|
| 1,155,506 | A | * | 10/1915 | Osaki | 36/72 R |
| 1,328,333 | A | * | 1/1920 | Mann | 36/50.1 |
| 1,666,290 | A | * | 4/1928 | Leigh | 602/65 |
| 2,660,812 | A | * | 12/1953 | Henke | 36/1.5 |
| 4,459,980 | A | | 7/1984 | Perser et al. | 602/27 |
| 4,523,394 | A | * | 6/1985 | Lindh et al. | 36/89 |
| 4,621,648 | A | | 11/1986 | Ivany | 602/27 |
| 4,753,229 | A | * | 6/1988 | Sutherland | 602/27 |
| 4,817,589 | A | | 4/1989 | Wertz | 602/28 |
| 4,864,741 | A | * | 9/1989 | Beauchemin | 36/89 |
| 4,922,630 | A | * | 5/1990 | Robinson | 36/89 |
| 4,936,295 | A | | 6/1990 | Crane | 602/29 |
| 4,982,733 | A | * | 1/1991 | Broadhurst et al. | 602/27 |
| 5,092,319 | A | | 3/1992 | Grim | 602/27 |
| 5,175,947 | A | | 1/1993 | Parracho | 36/89 |
| 5,213,564 | A | | 5/1993 | Johnson, Jr. et al. | 602/27 |
| 5,400,529 | A | | 3/1995 | Bell et al. | 36/93 |
| 5,430,960 | A | | 7/1995 | Richardson | 36/89 |
| 5,678,330 | A | | 10/1997 | Van Dyke et al. | 36/89 |
| 5,700,237 | A | * | 12/1997 | Hess | 602/27 |
| 5,771,608 | A | * | 6/1998 | Peterson | 36/89 |
| 5,792,087 | A | | 8/1998 | Pringle | 602/27 |
| 5,865,778 | A | | 2/1999 | Johnson | 602/27 |
| 6,423,021 | B1 | | 7/2002 | Gallegos | 602/23 |
| 6,503,218 | B1 | | 1/2003 | Ascheman | 602/23 |
| 2005/0177083 | A1 | * | 8/2005 | Heil | 602/27 |

* cited by examiner

*Primary Examiner*—Marie Patterson
(74) *Attorney, Agent, or Firm*—Ronald M. Anderson

(57) ABSTRACT

A ankle and foot stabilization support apparatus and method that provide stability while the user's foot is in the neutral, dorsiflexed, and plantarflexed positions. In one embodiment, the invention comprises a support foundation and two adjustable lateral tension bands. One band extends from the support foundation to a location on an item of footwear that is proximate to the lateral heel counter and provides support in the neutral and dorsiflexed position. The second band extends from the support foundation to a location on the item of footwear proximate to the lateral quarter and provides support in the plantarflexed position. Another embodiment includes medial stabilization tension bands. The invention can be readily moved from footwear to footwear, may be integrated into an item of footwear, and may contain a combination of lateral and medial tension bands.

39 Claims, 5 Drawing Sheets

ANKLE AND FOOT STABILIZATION SUPPORT

FIELD OF THE INVENTION

The present invention generally relates to the field of ankle and foot stabilization supports, and more specifically, relates to an apparatus and method to stabilize ankles and to prevent ankle sprains while the foot is in neutral, dorsiflexed, and plantarflexed positions.

BACKGROUND OF THE INVENTION

Due to the variety of physical activities in which people of all ages participate, it is inevitable that some will either incur or be susceptible to ankle injuries resulting from excessive, pathological motion of the foot. In fact, the ankle joint is one of the most frequently sprained joints in the body. The most common type of ankle sprain results from excessive inversion, in which the foot twists such that the sole of the foot moves toward the midline of the body. This type of sprain can be caused by the foot coming down on an uneven surface, or simply as a result of unexpected circumstances when involved in a sporting activity. For example, a sprain may occur if a person is blocked by another player while jumping to make a basketball shot, so that the person's weight is applied to a leg while the foot is angled beyond a balanced state.

A number of prior art devices exist to reduce the likelihood of such sprains from occurring. However, before discussing such prior art, it may be helpful to briefly review anatomical terms that are relevant to the foot, and motions of the foot. Three reference planes are commonly employed when referring to the foot, each plane bisecting the ankle. The transverse plane divides the top and bottom of the foot, the frontal plane divides the front and back of the foot, and the sagittal plane divides the left and right sides of the foot. The lateral side of the foot refers to the side of the foot away from the mid-line sagittal plane, while the medial side is the side closer to the mid-line sagittal plane. The dorsum of the foot is the top part of the foot, and the plantar surface of the foot is the sole of the foot. In the horizontal transverse plane that divides the foot into a top and bottom reference plane, abduction motion occurs when the foot rotates laterally or away from the center of the foot, and adduction motion occurs when the foot rotates medially or towards the center of the foot. In the vertical frontal plane that divides the foot into the front and back, inversion motion occurs when the foot twists such that the plantar surface of the foot faces toward the midline of the body, and eversion motion occurs when the foot twists such that the plantar surface of the foot faces away from the midline of the body. In the vertical sagittal plane that divides the foot into a left and right side, plantarflexion motion occurs when the foot moves downward from the tibia or away from the anterior leg and distally such that the angle between the foot and leg is increased; and dorsiflexion motion occurs when the foot moves upward towards the tibia such that the angle between the foot and leg is decreased. Of the above-mentioned motions, the ones most commonly implicated in lateral ankle sprains are excessive lateral frontal plane motion of the foot (i.e., inversion), and external rotation (transverse plane) motion of the leg.

Ankle sleeves, ankle wraps, and ankle foot orthoses are prior art devices that have attempted to prevent excessive motion which can result in a sprain, often referred to as pathological motion. Ankle sleeves are formed of elastic conforming material that encompass the foot and ankle, and usually employ an open heel design. Ankle wraps include either a sleeve base coupled with a strap positioned to stabilize the ankle or a lace-up design with medial or lateral stays to limit frontal plane motion. Ankle orthoses consists of plastic shells and stays that may be hinged to allow sagittal plane motion and limit frontal plane movements. Both ankle sleeves and ankle wraps provide a proprioceptive effect and some degree of mechanical stability. And, although ankle foot orthoses also provide mechanical stability, such orthoses only do so when the foot is flat on the ground and the ankle is in a "closed-packed" position. This design is ineffective when the ankle plantar flexes, because the rear foot and ankle can still invert and rotate within the fixed stays and within the shoe, enabling a sprain to occur.

U.S. Pat. No. 4,922,630 (Robinson) discloses a device that is included with a shoe and which has a leg engaging strap to provide support in one direction. This patent asserts that the design disclosed prevents inversion, while permitting a full range of eversion, plantarflexion, and dorsiflexion motion. However, the support disclosed in the Robinson patent does not provide any support to the forefoot, which is particularly vulnerable when the foot is in a plantarflexed position. Further, the device disclosed in this patent is integrated into a shoe. Thus, a separate support and shoe is required for every style or type of shoe that is worn when such support is desired.

U.S. Pat. No. 4,621,648 (Ivany) discloses an ankle support system including an ankle brace portion and a strap support portion. The ankle brace portion is removably attached to the user's foot. One or more straps are attached to the user's shoe, and the straps are connected to the ankle brace portion during use in a variety of wrapping patterns. The Ivany patent asserts that the support described therein restrains the joint from overextension and provides unimpeded motion of the ankle joint through its normal range of motion. The support disclosed in the patent includes an ankle brace that can be readily used with different footwear, but the straps that are disclosed appear to be permanently attached to specific shoes, such that one set of straps cannot be easily moved from one set of footwear to another. Because it encompasses parts of the foot that are normally enclosed by footwear, the ankle brace can interfere with the fit of certain styles of footwear, and the process of preparing the support for each use (i.e., donning the ankle brace, donning the item of footwear, and wrapping the straps about the ankle brace) is cumbersome. Significantly, the support disclosed in the Ivany patent, like the support disclosed in the Robinson patent, does not provide any support to the forefoot, which as noted above, is particularly vulnerable when the foot is in a plantarflexed position. Furthermore, the support disclosed by Ivany does not provide any tension band effect. A tension band, which can be selectively adjusted by a user, is likely to provide significantly more support than the ankle wrap disclosed by Ivany.

It would therefore be desirable to provide a method and apparatus for supporting a user's foot to reduce the likelihood of pathological motion resulting in a strain or injury. The method and apparatus should enable a relatively full range of normal motion, should easily be movable from shoe-to-shoe, and should provide support to the foot not just in neutral and dorsiflexed positions, but also in the plantarflexed position as well. The prior art does not teach or suggest a complete solution to the problems discussed above.

SUMMARY OF THE INVENTION

A first aspect of the invention is a ankle and foot stabilization and support apparatus including a support foundation, preferably implemented as an ankle collar, and a plurality of tension bands configured to provide support for specific portions of a user's foot. The degree of tension associated with each tension band is selectively adjustable. The support apparatus can be integrated into an item of footwear, or the support apparatus can be configured to be usable with a plurality of different items of footwear that have each been modified for such use. The tension bands can provide support to either or both of the lateral and medial sides of a user's foot. Particularly useful tension bands include those configured to support a lateral side of the user's foot during both dorsiflexed and plantarflexed motion, and those configured to support a medial side of the user's foot, to limit medial ankle sprains, and to provide support to the posterior tibial tendon in pathological conditions such as posterior tibial tendon dysfunction (PTTD) and severe flat-foot deformities. Various combinations of medial and lateral tension bands can be implemented in accord with this invention. As noted above, the tension bands are preferably implemented as selectively tensionable straps; however, other types of tension bands, such as those formed out of resilient materials or springs, might alternatively also be used. The ankle collar is preferably attached to the user's leg at a level substantially adjacent to the user's ankle malleoli.

A particularly preferred embodiment of a support apparatus in accord with the present invention includes an ankle collar and two lateral tension bands. A first lateral tension band is attached to the ankle collar and engages a location proximate to the lateral quarter of the footwear that is worn by a user, approximately adjacent to the base of the fifth metatarsal bone of the user's foot. This first lateral tension band provides most of the support while the user's foot is in the particularly vulnerable plantarflexed position. A second lateral tension band is also attached to the ankle collar, and engages the footwear at a location proximate a lateral heel counter of the footwear. The second lateral tension band provides most of the support while the user's foot is in the neutral or dorsiflexed position, and is particularly useful in preventing ankle sprains due to inversion. If desired, medial tension bands can also be included.

Preferably each tension band slidingly engages an attachment member coupled to the item of footwear at the above noted locations. The user selects a desired tension by causing the tension band to engage the attachment member, moving the tension band until a desired tension has been achieved, and securing the tension band to maintain the desired tension. When the tension band is implemented as a strap, hook and loop fasteners and or buckles can be beneficially employed to secure the tension bands with the desired tension. Hook and loop fasteners can also be beneficially employed in removably attaching the ends of the ankle collar to secure the ankle collar to the user's leg.

Another embodiment of a support apparatus in accord with the present invention includes the ankle collar and two medial tension bands. A first medial tension band is attached to the ankle collar and engages the footwear at a location close to the medial quarter of the footwear, approximately adjacent to the navicular tuberosity (and the insertion of the posterior tibial tendon into the navicular tuberosity) of the user's foot. A second medial tension band is also attached to the ankle collar and engages the footwear at a location proximate to the medial heel counter, such that when the user's foot is inserted into the item of footwear and the support apparatus is properly adjusted, the second medial tension band is disposed adjacent to the user's posterior tibial tendon. The user selectively adjusts the tension associated with each tension band as described above. If desired, lateral tension bands such as those described above can also be included.

For embodiments in which the support apparatus is intended to be utilized with only one specific item of footwear, the ankle collar will preferably be sold with the item of footwear, and the tension bands and the attachment members integrated into the shoe. The support apparatus of the present invention can also be provided as an ankle collar and tension bands that can be moved from one item of footwear to another. Each different item of footwear must include the required attachment members, which can be fitted to an item of footwear after manufacture, or can be integrated into the item of footwear when manufactured. In one embodiment, the attachment members are implemented as D-rings (or other shaped rings), which slidingly engage the tension bands. Attachment members can also be implemented as buckles; however, incorporating buckles sufficiently large to engage a tension band with the desired tension may detrimentally impact the aesthetic appearance of the item of footwear. The tension bands can alternatively be threaded through a slot or opening formed in the item of footwear at the appropriate location.

In the particularly preferred embodiment of a support apparatus including an ankle collar and two lateral tension bands, where the first lateral tension band is configured to be disposed approximately adjacent to the base of the fifth metatarsal bone of the user's foot, if the position of the first lateral tension band is fixed relative to the ankle collar, then the first lateral tension band will only be properly disposed relative to the foot of a user if the user's foot falls within a relatively narrow range of sizes. When a user with a larger or a smaller size foot attempts to use such a support, the first lateral tension band will likely not be positioned as desired relative to the user's fifth metatarsal bone. However, pivotally attaching the first lateral tension band to the ankle collar will enable a single support apparatus to be utilized by persons having feet of disparate sizes. Such a pivotal attachment can also be implemented in support apparatus configured to provide medial support, to ensure a tension band is properly positioned relative to a specific user's foot.

Yet another aspect of this invention relates to a method for providing support to a user's foot when wearing an item of footwear. The method includes the step of providing an ankle collar that is located close to a user's ankle malleoli, and then positioning a first tension band such that the first tension band engages the ankle collar either at a location near the lateral quarter of the item of footwear or at a location proximate to the medial quarter of the item of footwear. When the first tension band is properly positioned to engage the item of footwear at a location near the lateral quarter of the item of footwear, the first tension band provides support to a user's foot in a plantarflexed position. When the first tension band is properly positioned to engage the item of footwear at a location near the medial quarter of the item of footwear, the first tension band is disposed proximate a navicular tuberosity of the user's foot.

The method can further include the steps of positioning a second tension band so that it engages the ankle collar and the item of footwear at either a third location proximate to the lateral heel counter or a fourth location proximate to the medial heel counter of the item of footwear, and adjusting the tension associated with each tension band until it is loaded to a desired tension. Each tension band is then secured to maintain the desired tension.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein:

FIG. 1 is an isometric view of a first embodiment of a lateral ankle and foot stabilization support apparatus, in accord with the present invention, showing the apparatus attached to an item of footwear;

FIG. 2 schematically illustrates a second embodiment of a lateral ankle and foot stabilization support apparatus, in accord with the present invention, showing a support foundation and two tension bands;

FIG. 3A schematically illustrates the second embodiment providing support to a user's right foot, while the user's foot is in a neutral position;

FIG. 3B schematically illustrates the second embodiment providing support to a user's right foot, while the user's foot is in a dorsiflexed position;

FIG. 3C schematically illustrates yet another embodiment of the present invention providing support to a user's right foot, while the foot is in the plantarflexed position;

DESCRIPTION OF THE PREFERRED EMBODIMENT

FIGS. 1–4B illustrate various embodiments of a lateral ankle and foot stabilization support apparatus in accord with the present invention. FIG. 5 illustrates a medial ankle and foot stabilization support apparatus. While the lateral and medial embodiments differ in respect to where they engage an item of footwear, both the lateral and medial embodiments are characterized by including a support foundation configured to engage a user's leg proximate to the user's ankle malleoli, and a plurality of tension band members that engage different portions of the item of footwear. The portion of the item of footwear that the tension band members engage determines the type of support that the ankle and foot stabilization support apparatus provides. Preferably, lateral embodiments will enhance stability while the user's foot is in the neutral, dorsiflexed, and plantarflexed positions, thereby reducing ankle sprains relating to inversion. Medial embodiments of the present invention provide support in order to limit PTTD, severe flatfoot deformities, and ankle sprains relating to eversion. If desired, a single ankle and foot stabilization support apparatus in accord with the present invention can include a combination of lateral and medial tension bands to achieve both of these functions.

Figure 1:
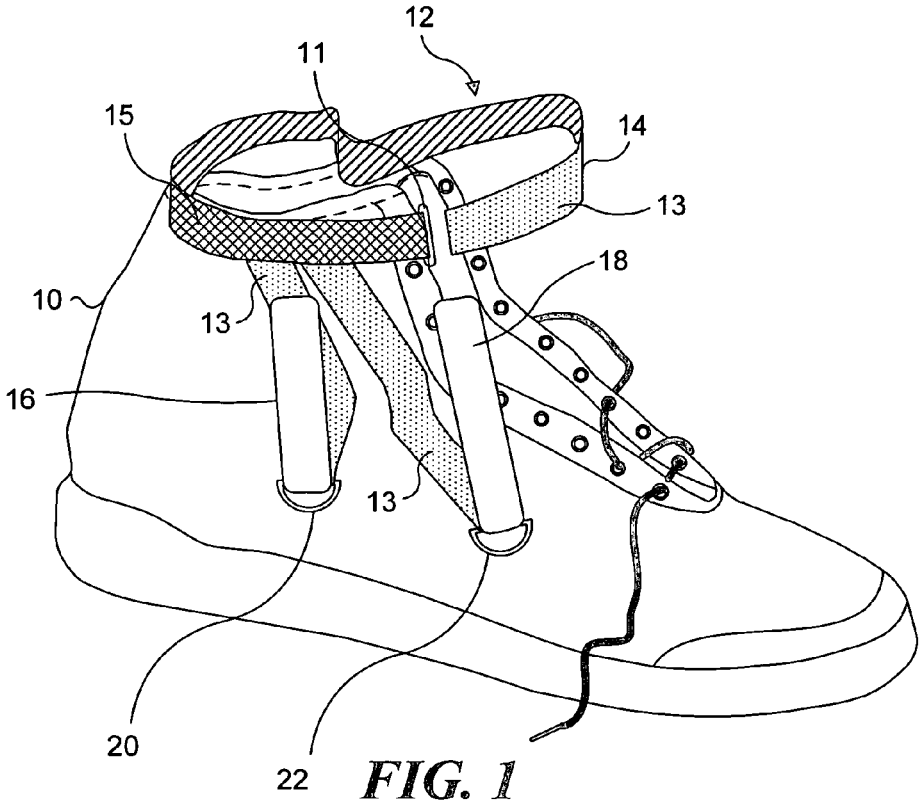

FIG. 1 shows a first embodiment of a lateral ankle and foot stabilization support apparatus. Lateral ankle and foot stabilization support 12 includes an ankle collar 14, a first tension band 16, and a second tension band 18. Ankle collar 14 is shown unfastened, and disposed adjacent to an upper collar of an item of footwear 10. Ankle collar 14 functions as a support foundation that is removably attached to a user's leg proximate to the user's ankle malleoli. As will be described below, a plurality of tension bands engage both the support foundation and the item of footwear. Those of ordinary skill in the art will recognize that, in addition to the ankle collar shown in FIG. 1, other types of support foundations could be utilized. For example, as opposed to the strap based collar shown, a clam shell type support foundation (not separately shown) could be employed. The specific implementation of the support foundation is not critical, and in some instances, it may be desirable to incorporate the support foundation into the item of footwear, if the item of footwear has a sufficient high top extending above the user's ankle. However, in such an embodiment, the ankle and foot stabilization support apparatus will not be able to be used with a different item of footwear. Generally, removable support foundations not permanently attached to an item of footwear are preferred, because they enable the ankle and foot stabilization support apparatus to be used with different items of footwear. Whatever support foundation is employed, the support foundation must position the ankle and foot stabilization support apparatus relative to the user's foot, and engage the plurality of tension bands.

Referring once again to FIG. 1, one end of ankle collar 14 is configured to pass through a buckle or metal loop 11. Ankle collar 14 includes a hook portion 15 and a loop portion 13, enabling ankle collar 14 to be removably attached to a user's leg. Of course, the relative positions of the hook and loop portions can be reversed. While hook and loop type fasteners are preferred because they are simple and robust, it should be understood that the ankle collar could be removably attached using other mechanisms, including but not limited to other types of fabric fasteners, laces, and buckles. Thus, hook and loop fasteners are to be considered exemplary and preferred, but not limiting on the scope of the invention.

One end of a tension band 16 is attached to ankle collar 14, and an opposite end of tension band 16 passes through a D-ring 20. One end of a tension band 18 is also attached to ankle collar 14, and an opposite end of tension band 18 passes through a D-ring 22. As will be described in detail below, D-ring 20 is preferably disposed generally adjacent to a lateral heel counter of the item of footwear, while D-ring 22 is disposed generally adjacent to a base of a user's fifth metatarsal when the user's foot is properly and fully inserted into the item of footwear, which is assumed to correctly fit the user's foot in regard to both width and length. Indeed, as used herein and in the claims that follow, the phrase indicating that a "user's foot is properly positioned in the item of footwear" is intended to mean that the user's foot is fully inserted into the shoe that is of the correct size to fit that foot and is in a state as normally intended when the item of footwear is worn.

As shown in FIG. 1, tension band members 16 and 18 are not yet tightened, and are not yet providing any support. Tension band members 16 and 18 are configured such that one end of each tension band is attached to the ankle collar, and an opposite end (i.e., the free end) slidingly engages an attachment point on the item of footwear, enabling the free end to be pulled back up toward the ankle collar sufficiently to load the tension band with a desired level of tension. It should be understood that in addition to D-rings, other elements such as buckles and openings formed into the item of footwear, can be used to slidingly engage the tension bands. As will be discussed in detail below, the tension bands in each embodiment of the present invention (lateral or medial) must be tightened (or tensioned) sufficiently to provide adequate support to the user's foot and ankle. Preferably, the tension bands limit pathological motion of the users foot to only a few millimeters. Tension bands 16 and 18 each include loop portions (shown as a dotted pattern) 13, which will engage corresponding hook portions (shown as a grid pattern) 15 of ankle collar 14 when support 12 is properly adjusted. Again, the location of the hook and loop portions can be interchanged, if desired.

Tension bands 16 and 18 and ankle collar 14 are preferably implemented as NYLON™ (or other suitable fabric with limited elastomeric properties) straps including the above-noted hook (or loop) portions. As explained above, the desired tension is loaded into the tension bands 16 and 18 by pulling the straps back up toward the ankle collar, and removably attaching the free end of the straps to the ankle collar using the hook and loop fasteners (or other types of fasteners, such as buckles shown in FIG. 3C) until sufficient tension is achieved to prevent the undesired motion of the user's foot and ankle. It should be understood that other types of tension bands 16 and 18 can be employed. For example, a polyester or other material can be employed for the tension bands. If the user needs to readjust the tension bands 16 and 18 to achieve the desired tension, the user can pull a second end of the tension band generally away from where it is attached, freeing it from the tension. Then, the user can generally pull (or loosen if too tight) the tension band relative to its attachment point on the footwear until the desired tension is achieved and then reattach the tension band to maintain the desired tension.

Figure 2:
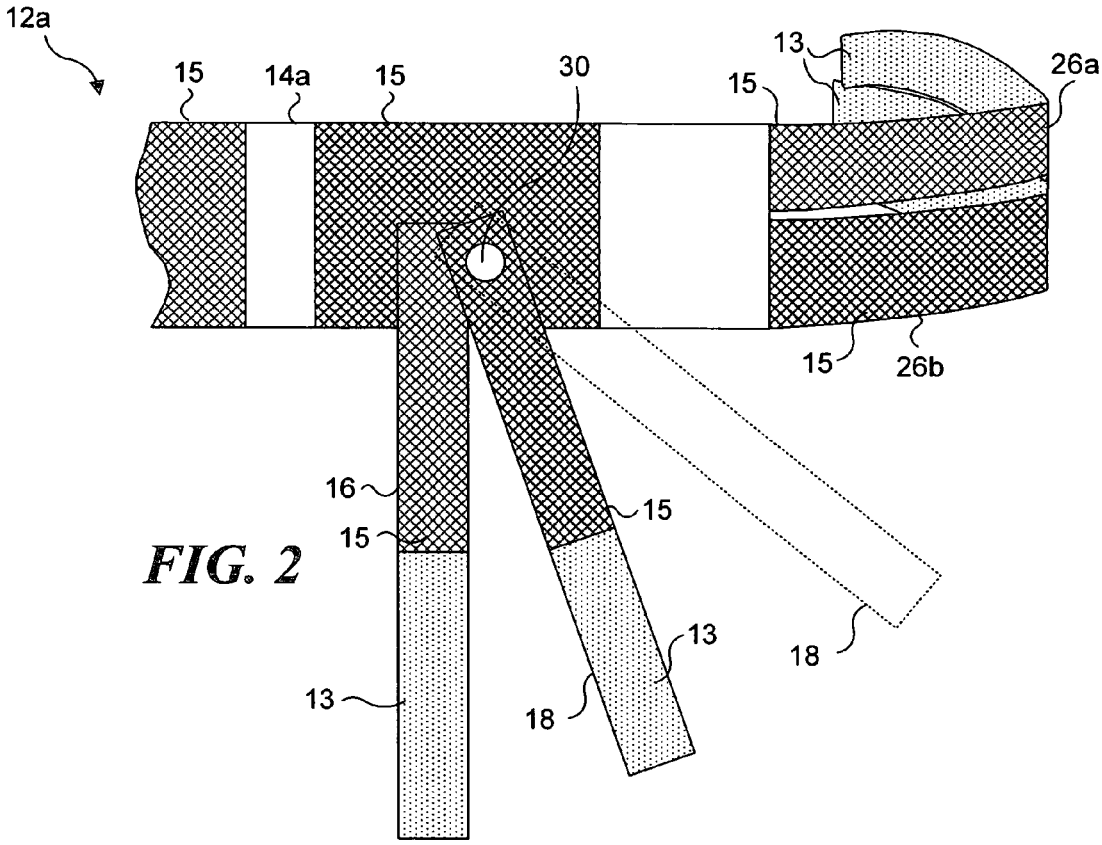

FIG. 2 illustrates a second embodiment of a lateral ankle and foot stabilization support 12*a* shown without an item of footwear, and shows the details of ankle collar 14*a*. The ankle collar is designed to be secured around the user's lower leg. Preferably, it will be disposed at a point proximately above the ankle malleoli so that it rests against the ankle malleoli in order to gain purchase and not slide down the user's leg. Ankle collar 14*a* includes a hook portion 15 and a loop portion 13, enabling ankle collar 14*a* to be removably attached to a user's leg. Of course, the relative positions of the hook and loop portions can be reversed, as already noted. In this embodiment, upper strap 26*a* is pulled around to encircle the user's leg and its loop portion 13 will engage its hook portion 15 with enough tension so that ankle collar 14*a* will not slip off or slide down when tension bands 16 and 18 are loaded with the desired tension. Ankle collar 14*a* is sufficiently long to be secured about a wide range of leg diameters, although its width can vary. But the ankle collar should be sufficiently wide to ensure user comfort and provide an adequate area for attaching the tension bands. The tension bands 16 and 18 can be of various lengths and are readily adjusted by the user to achieve the desired tension, which is sufficient to stabilize the foot and ankle so as to prevent injury, a reoccurrence of injury, or exacerbation of an existing injury. Preferably, tension bands 16 and 18 are of a length sufficient to enable the first end of each tension band to course distally from its attachment point on ankle collar 14*a* to where it slidingly engages its respective attachment point on the footwear (as discussed below), and to course proximally back to its respective attachment point on ankle collar 14*a*. This configuration enables lower strap 26*b* to encircle the user's leg and its loop portion 13 to engage its hook portion 15 so that it covers the second ends of tension bands 16 and 18, where they attach to ankle collar 14*a* thus helping to secure the tension bands in position and presenting an aesthetically pleasing appearance. However, those skilled in the art will realize that the second end of each tension band may protrude above the top of ankle collar 14*a* because the user achieves desired tension by pulling the second end generally away from the tension band's respective attachment location on the item of footwear and toward the ankle collar 14*a* or 14. Thus, in order to achieve the desired tension, the tension band may need to be pulled beyond the top of ankle collar 14*a* or 14. Also, it should be understood that this embodiment is not limited to an upper and lower strap for the ankle collar, since additional straps can be included to encircle the user's leg as part of ankle collar 14*a*. The first end of tension bands 16 and 18 may be fixedly attached to ankle collar 14*a* by being sewn or connected thereto with suitable fasteners, such as staples or rivets.

In addition, tension bands 16 and 18 should be of a length sufficient to enable each tension band to course distally from its attachment point at ankle collar 14*a* to where it slidingly engages its respective attachment point on the item of footwear (as discussed below), so that there is sufficient length left on the free end of the tension band to grasp and pull back toward the ankle collar to load the tension band with the desired tension. Each tension band should be provided in a length sufficient to enable the free end of the tension band to extend from the attachment point all the way back to the ankle collar, such that the free end of the tension band is removably attached to the ankle collar (see FIGS. 3A and 3B). Such attachment is preferably achieved using hook and loop fasteners, although other types of fastening systems, such as buckles, can be employed. Alternatively, once a desired tension has been loaded, the free end of the tension band can be secured using a buckle (as is shown in FIG. 3C). Note that support 14*a* is not drawn to scale in FIG. 2. For example, upper strap 26*a* and lower strap 26*b* may be shorter or longer than shown, and hook portions 15 may be shorter or longer relative to loop portions 13 than shown.

The tension band may itself include hook and loop fasteners, such that instead of, or in addition to attaching the free end of the tension band to the ankle collar, the free end of the tension band attaches to another portion of the tension band. In FIG. 2, each tension band includes both hook portions 15 and loop portions 13. The sizes and locations of the hook and loop portions are configured such that one portion of the hook and loop fastener system faces in the same direction as the tension band extends substantially from the ankle collar to the attachment point. Once the tension band engages the attachment point, the hook and loop portions face toward each other, such that the end of the tension band extending from the attachment point back toward the ankle collar attaches to the underlying part of the tension band. In such an embodiment, the tension band is not required to extend from the attachment point all the way back to the ankle collar. Ankle collar 14*a* has hook portion 15 to which hook portions 15 on the first ends of tension bands 16 and 18 are fixedly attached. Thus, if the user attaches the second end of either tension band slightly to the left, right, or above where its first end is attached to ankle collar 14*a*, the ankle collar's hook portion 15 will also engage loop portions 13 of the tension bands.

Lateral ankle and foot stabilization support 12 (or 12*a*) can be sold as a kit, such that one end of the tension bands are fixedly attached to the ankle collar, in positions that have been selected to provide support to persons having a specific size (or range of size) foot. As noted above, lateral tension band 18 preferably engages an attachment point disposed adjacent to the base of the user's fifth metatarsal. Thus, if tension band 18 is fixedly attached to ankle collar 12*a* (or ankle collar 12), then a user having feet that are substantially smaller or larger than a specific size will have their fifth metatarsal located such that tension band 18 cannot be readily positioned adjacent to the base of that user's fifth metatarsal. This problem can be avoided if tension band 18 is movably attached to the ankle collar, as is shown in FIG. 2. Support 12*a* includes a pivotal attachment 30 that enables tension band 18 to rotate relative to the ankle collar so that the free end of tension band 18 can engage an attachment point located adjacent to a base of a user's fifth metatarsal, regardless of the size of a user's foot. Preferably, pivotal attachment 30 is implemented as a swivel mount, or as a rivet, although other types of pivotal attachments can be employed. For example, a ring can be attached to ankle collar 14*a*, and one end of tension band 18 can engage the ring, enabling the tension band to be positioned as required. Tension band 18 may be capable of a full 360 degree pivotal rotation about pivotal attachment 30, or may be constrained to a smaller angle of rotation. Furthermore, the distance that separates the attachment locations of tension bands 16 and 18 at ankle collar 14 or 14*a* can be varied as required to enable each tension band to engage an attachment point at a desired location on an item of footwear.

Figure 3A:
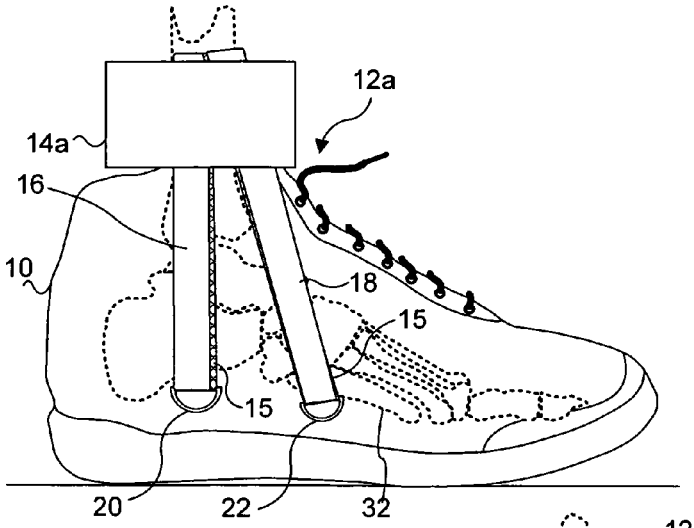
Figure 3B:
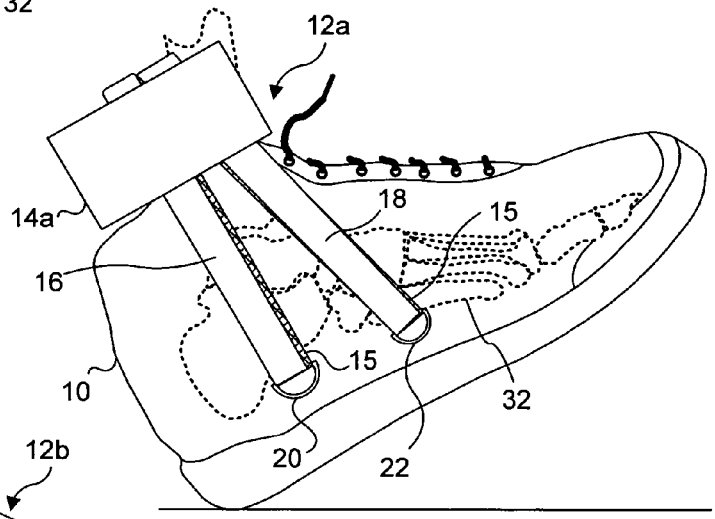
Figure 3C:
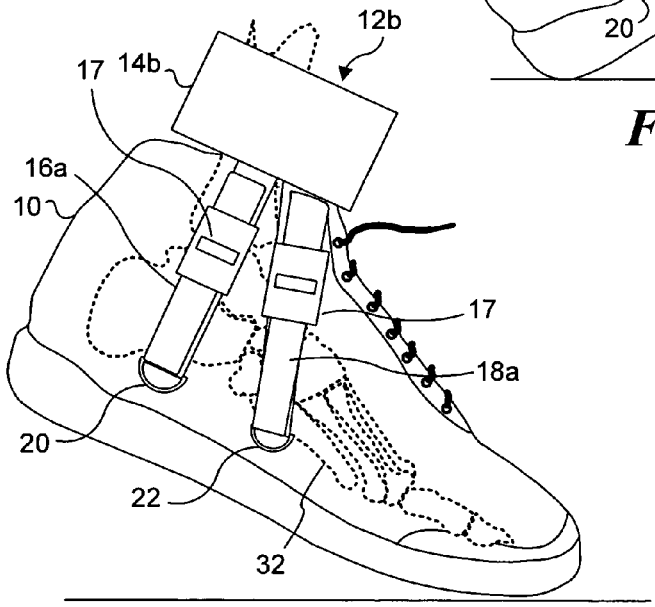

FIG. 3A illustrates how support 12*a* stabilizes and supports the user's foot in the neutral position. Tension band 16 courses distally from where its first end is attached to ankle collar 14*a* to where it slidingly engages D-ring 20. As shown, the free ends of tension bands 16 and 18 have engaged D-rings 20 and 22, and have been pulled back toward ankle collar 14*a*, where they are removably attached to the ankle collar and covered by the overlapping part of the ankle collar. A portion of each tension band includes loop portions 13 (which are obscured from view (see FIG. 2)) that engage hook portions 15. As noted above, while including both hook and loop portions on the tension band enhances the robustness of the fastening of the support in the adjusted position, the support can be configured such that the tension bands are fastened only to the ankle collar.

Figure 4A:
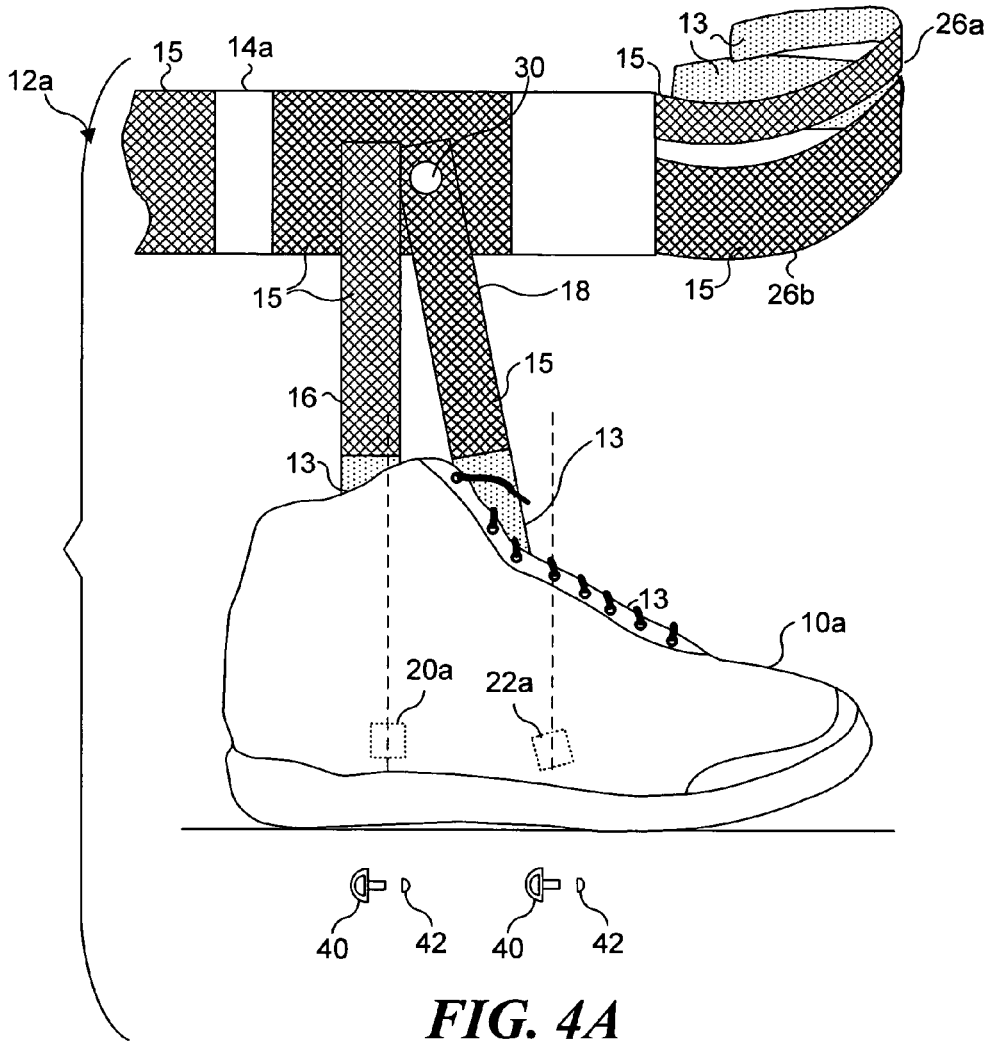
FIG. 4A is an exploded lateral side view showing details relating to preferred engagement points on the item of footwear for the two tension bands of the second embodiment, in relation to the length of the user's foot.
Figure 5:
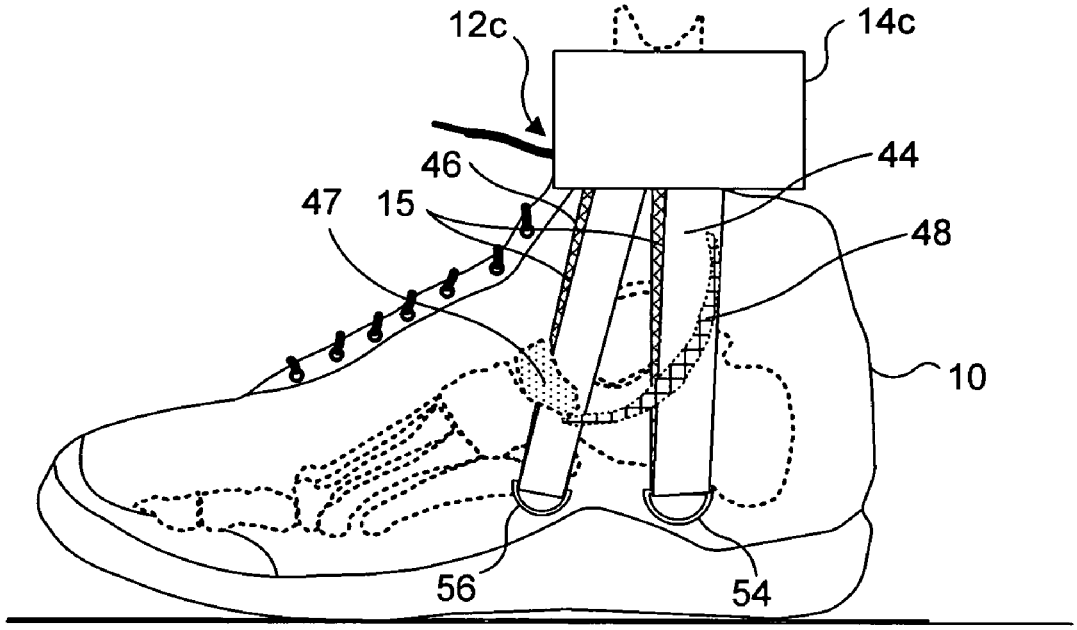
FIG. 5 is a medial side view of a user's right foot in the neutral position, showing yet another embodiment of the present invention, and illustrating how the invention provides support to at least the navicular tuberosity and the insertion of the posterior tibial tendon.

Note that D-ring 20 is disposed proximate the lateral heel counter of item of footwear 10, such that tension band 16 is substantially perpendicular to a sole on item of footwear 10 (see FIG. 4A). When properly positioned and adjusted, tension band 16 provides a majority of the support and stabilization of the user's rear foot while it is in either a neutral position (FIG. 3A) or a dorsiflexed position (FIG. 3B), reducing a risk of injury and ankle sprain relating to inversion of the user's foot, and preventing a reoccurrence of such injuries or the exacerbation of a previous injury. See page 2 for a more detailed description. The combination of the ankle collar 14*a* and tension band 16 creates a tension band effect that enhances normal ligamentous ankle anatomy, while limiting excessive lateral frontal plane and external rotation transverse plane motion, which are the motions most commonly implicated in lateral ankle sprains. It should be understood that as shown in the Figures, the relative position of D-ring 20 is approximate, and knowledge of anatomy and due care must be exercised to ensure that D-ring 20 (or a corresponding element employed to engage tension band 16 such as a slotted opening or a buckle affixed to the item of footwear) is positioned in an anatomically correct position as necessary to provide the desired support.

Figure 4B:
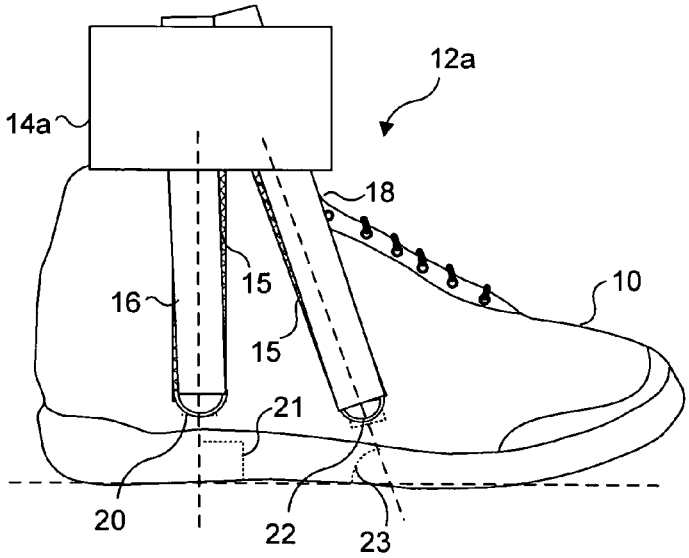
FIG. 4B is a lateral side view showing the two tension bands of the second embodiment engaging the item of footwear at the preferred locations.

Similarly, D-ring 22 is disposed substantially adjacent to a base of a user's fifth metatarsal 32 (as indicated by the phantom rendering of the bones of a user's foot). Again, it should be understood that as shown in the Figures, the relative disposition of D-ring 22 is also approximate, and knowledge of anatomy and due care must be exercised to ensure that D-ring 22 (or a corresponding element employed to engage tension band 18, such as a slotted opening or a buckle affixed to the item of footwear) is positioned in an anatomically correct position to provide the desired support. An acute angle is formed between tension band 18 and a sole of the item of footwear (i.e., the angle on the side closest to tension band 16) as shown in FIG. 4B. This configuration enables tension band 18 to provide a majority of the support and stabilization of the user's forefoot while it is in the vulnerable plantarflexed position (see FIG. 3C).

Referring now to FIG. 3C, in addition to showing a foot in a plantarflexed position, where tension band 18*a* is particularly effective in providing support, FIG. 3C also illustrates a support 12*b* that employs an alternative mechanism to secure the free end of the tension bands after each tension band has been loaded with the desired tension. Buckles 17 are included, such that once the free end of the tension bands have engaged their respective attachment points (i.e., D-rings 20 and 22), the free end then engages one of these buckles disposed between the attachment point and ankle collar 14*b*. As shown, the free ends are not fixedly attached to ankle collar 14*b*, although if desired, in addition to providing buckles 17, a fastening system could be implemented for this purpose. Tension bands 16*a* and 18*a* are not required to include the hook and loop fastening portions described above; however, if desired, in addition to buckles 17, such fastening elements could be included.

FIG. 4A shows a an item of footwear 10*a* that does not yet have D-rings or any other elements installed that can engage tension bands 16 and 18. Preferred attachment points 20*a* and 22*a* are indicated in phantom view. Again, the preferred attachment points are based on the anatomical location of specific portions of a user's foot and may vary somewhat based on the size and shape of a specific individual foot. To enable support 12*a* to be used with item of footwear 10*a*, the D-rings are provided as loose components, including a ring and shaft 40, and a seat 42. Seat 42 is configured to securely attach to shaft 40, thereby securing the D-ring to the item of footwear 10. A user can drill or otherwise form a small opening in the item of footwear 10 at preferred attachment point 20*a* to enable the shaft portion of ring and shaft 40 to pass through the heel counter of the item of footwear, such that seat 42 is attached to the shaft inside the item of footwear. Similarly, a small opening can be formed in the item of footwear at preferred attachment point 22*a*, enabling the other D-ring to be attached. Preferably the shaft of ring and shaft 40 is relatively short, such that it does not protrude any further into the item of footwear than is required to enable seat 42 to gain sufficient purchase to securely attach to the shaft. If the shaft portion is provided too far into the item of footwear, it could cause discomfort by rubbing against the user's heel. For this reason, seat 42 should be configured to have a low profile and be smooth. Selecting attachment points 20*a* and 22*a* such that they are relatively close to the sole of the item of footwear will reduce a likelihood that the installed D-rings will cause discomfort. As will be described in more detail below, appropriately sized openings can be implemented in place of D-rings 20 and 22. Those of ordinary skill in the art will readily recognize that a plurality of different size and shape fastening systems are available that can be used, instead of those described above, to slidingly engage the tension bands.

As indicated above, selecting the appropriate positions for the openings formed in the item of footwear for attachment points 20*a* and 22*a* requires an understanding of the anatomy of the human foot. Because the support provided by the present invention is likely to be important to collegiate and professional athletes, it is likely that team physicians and trainers will be able to assist athletes in selecting the appropriate locations required to achieve the maximum benefit. In addition, a shoe repair facility can be employed to install the attachments on a user's item of footwear, if desired. More casual users of the support can also consult with foot specialists to assist in installing attachment points on existing footwear, such that supports in accord with the present invention can be used.

Turning now to FIG. 4B, support 12*a* has been installed on the item of footwear 10, and tension bands 16 and 18 have been loaded with a desired tension and secured to ankle collar 14*a* (using lower strap 26*b* shown in FIG. 4A). Note that when D-rings 20 and 22 have been installed at preferred attachment points as discussed above, tension band 16 is substantially perpendicular to a sole of the item of footwear 10, as indicated by right angle 21, and tension band 18 forms an acute angle 23 relative to the sole of the item of footwear (acute angle 23 is on the side of tension band 18 closest to the heel, as opposed to the side closest to the toe).

FIG. 5 illustrates support 12*c*, a third embodiment of the invention, in which the plurality of tension bands are configured to support a medial side of the user's foot. When properly positioned, these medial tension bands support at least the navicular tuberosity and the posterior tibial tendon.

A tension band 44 has a first end attached to ankle collar 14*c*. When properly adjusted, tension band 44 extends from ankle collar 14*c* to a D-ring 54, where the tension band slidingly engages the D-ring, and then extends back to ankle collar 14*c*. As discussed above, once a desired tension has been loaded on a tension band (by engaging the tension band with the D-ring, and pulling the tension band back toward the ankle collar), the tension band can be secured in a number of different ways, such as by attaching a free end of the tension band to the ankle collar, attaching the free end of the tension band to the underlying portions of the tension band using hook and loop fasteners, using a buckle, or a combination thereof. Tension band 44 is disposed to provide support to the posterior tibial tendon, which is shown superimposed over tension band 44. To ensure that tension band 44 is properly positioned to support the posterior tibial tendon, care must be taken when determining where on the item of footwear D-ring 54 (or some other attachment member as described above) is to be attached. As discussed in greater detail above, such attachment points can be integrated in the shoe at the time of manufacture, so that the designer of the shoe determines the correct position. For shoes that are retrofitted after manufacture, a foot specialist can be consulted to determine the correct position.

A tension band 46 also has a first end attached to ankle collar 14*c*. When properly adjusted, tension band 46 extends from ankle collar 14*b* to a D-ring 56, where the tension band slidingly engages the D-ring, and then extends back to ankle collar 14*c*. Tension is adjusted to achieve the desired tension, and the tension band is secured in the desired position, as discussed above. When tension band 46 is properly positioned and adjusted, it is preferably disposed proximate a user's navicular tuberosity 47, which is shown superimposed over tension band 46. To ensure that tension band 46 is properly positioned to support the navicular tuberosity, care must be taken when determining where on the item of footwear the attachment member (i.e., D-ring 56) is to be attached. Again, a foot specialist can be consulted to select the desired position, or instructions can be provided in a kit for a consumer to install the required attachment hardware. The preferred attachment point for D-ring 54 is proximate to the medial heel counter, just under the medial malleolus.

Tension bands 44 and 46 can each include loop portions 13, which will engage with corresponding hook portions of ankle collar 14*c* when support 12 is properly adjusted. As discussed above, each tension band can include both hoop and loop fastener portions (see FIG. 2), such that the tension bands can be secured to themselves, instead of or in addition to collar 14*c*. Ankle collar 14*c* can be implemented either using ankle collar 14 of FIG. 1, ankle collar 14*a* of FIG. 2, or a modification thereof. Thus, it should be understood that one or both of the tension bands attached to ankle collar 14*c* can be movably attached to the ankle collar, as discussed in detail above with respect to FIG. 2, such that support 12*c* can be utilized by users having a variety of different size feet. Ankle collar 14*c*, combined with the two medial tension members 46 and 44, creates a tension band effect that will limit medial ankle sprains and provide support to posterior tibial tendon 48 in order to limit PDDT and severe flatfoot deformities. Thus, support 12*c* enhances the function of the item of footwear and any insert within the item of footwear that is fabricated to counter the pronatory force on the foot and ankle.

Figure 6A:
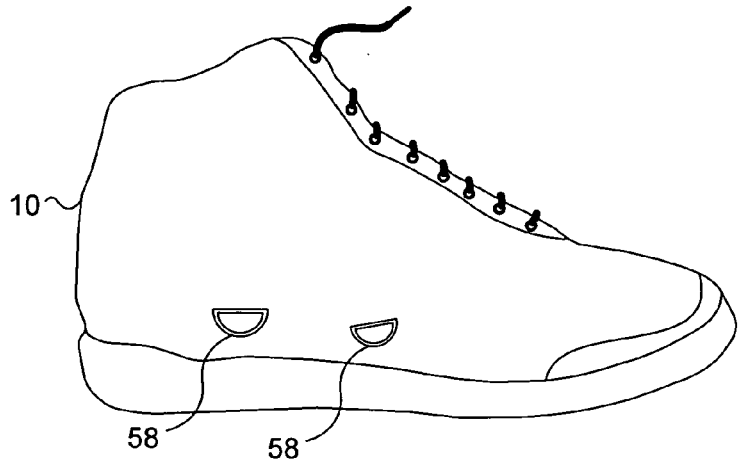
FIG. 6A is a side view of an item of footwear showing D-rings mounted to the item of footwear, such that the two tension bands can engage the D-rings when using the invention.
Figure 6B:
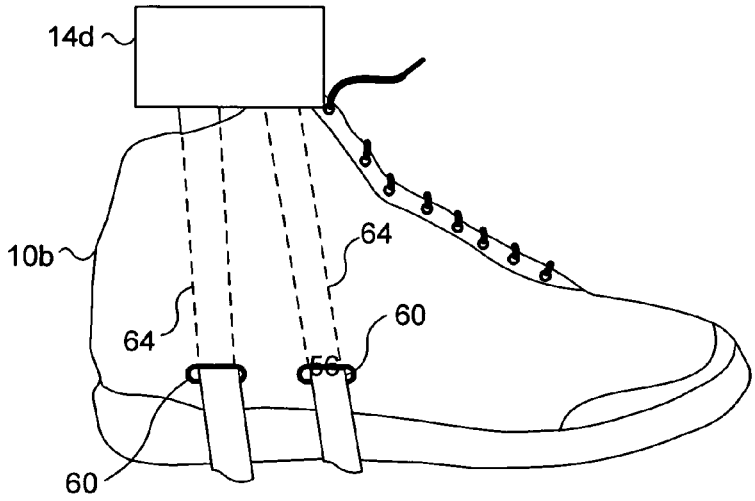
FIG. 6B is a side view of an item of footwear showing slots formed into the item of footwear, such that two tension bands can extend through the slots from inside the item of footwear.
Figure 6C:
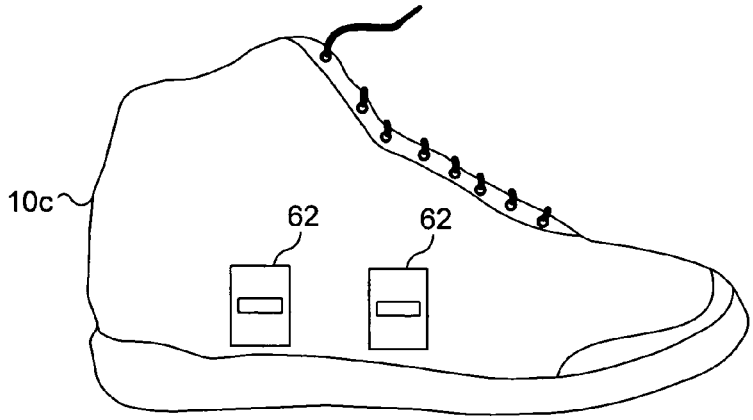
FIG. 6C is a side view of an item of footwear showing buckles mounted to the item of footwear, such that two tension bands can engage the buckles.

FIGS. 6A–6C show a variety of different techniques that can be implemented to enable tension bands to engage a desired location on an item of footwear. FIG. 6A illustrates how D-rings 58 (or functionally similar hardware) are attached to item of footwear 10. Such hardware can be installed on the item of footwear at the time of manufacture, after manufacture by a foot specialist, by a consumer, or a shoe repair facility by following the directions in a kit in which this embodiment is sold.

FIG. 6B shows tension bands 64 extending from an ankle collar 14*d* toward slotted openings 60 formed into the item of footwear at preferred locations. After passing out through slotted openings 60, the free ends of the tension bands can be pulled back toward ankle collar 14*d* to load the tension bands to the desired tension, and the tension bands are then secured to maintain the desired tension, generally as described above. At least one portion of each tension band, such as the portion extending from the ankle collar to the opening, or the portion extending upward from the slotted opening back toward the ankle collar (shown in phantom) is disposed within the item of footwear. As discussed above, slotted openings 60 can be formed into the item of footwear at the time of its manufacture, or post manufacture. Preferably, the slotted openings include a grommet or other reinforcement (not separately shown) about the periphery of the opening, to prevent undue wear when the tension bands abrade against the sides of the slotted openings.

FIG. 6C shows buckles 62 attached to the item of footwear at the preferred locations (as discussed above, the preferred locations varying depending on where the tension band is to be located, such as on the medial or lateral side, and what the type of support the tension band is configured to provide). The use of buckles 62 will enable the tension to be loaded on the tension bands as the buckle is engaged, and the buckles will also secure the tension bands so as to maintain the desired tension. When buckles 62 are employed, tension bands need not (but may) extend upward from the buckles and back to the an ankle collar (not shown). While functional, some consumers may feel such buckles are not aesthetically pleasing, and it is likely that consumers may prefer other embodiments.

It should be understood that alternative attachment systems can also be used in the embodiments shown in FIGS. 6A–6C within the scope of this invention. The attachment system employed to enable the tension bands to engage the item of footwear at the desired location must be able to accommodate the configuration of the tension bands and sustain the desired tension over the normal life of the item of footwear. A combination of attachment systems is possible; for example, D-rings 58 may be used on the lateral side of the footwear, while slotted openings 60 or buckles 62 are used on the medial side of the item of footwear, or vice versa.

Also, the invention is not limited to the specific embodiments disclosed (i.e., either two lateral tension bands or two medial tension bands). Other combinations of medial and lateral tension bands can be readily implemented. For example, some supports may include two lateral tension bands and one medial band member, or one lateral tension band and two medial band members, or two lateral tension bands and two medial band members. Further, while the two lateral and two medial tension bands positioned as described above provide beneficial support, additional tension bands engaging additional items of footwear at other locations can also be employed.

While the discussion of each of the above noted embodiments has indicated that one end of each tension band is fixedly attached to the ankle collar, it should be understood that such a configuration is merely exemplary and does not limit the invention. If desired, the tension bands can be provided as separate elements that are removably attached to the ankle collar (or other support structure). In such an embodiment, the fastening system that is employed to secure the tension band to the ankle collar should be sufficiently robust to enable the desired tension to be loaded for each tension band. Those of ordinary skill in the art will recognize that other types of fasteners can be selected for this purpose, and the most significant feature of any fastener selected is that it be able to withstand the desired tension loaded in the tension bands.

While it is desirable to be able to use an ankle support with more than one item of footwear, it should be understood that the present invention also encompasses the concept of integrating the ankle collar into an item of footwear. The tension bands can be similarly integrated, or removably attachable to the integrated ankle collar, generally as described above. A support foundation in accord with the present invention can be used with any type of footwear that can be configured to engage the tension bands at a level above the ankle of a user, and thus the invention is not limited to use only with athletic shoes. Other footwear, including but not limited to work shoes, dress shoes, or casual shoes can benefit from the support to the foot and ankle provided by this invention.

Although the present invention has been described in connection with the preferred form of practicing it and modifications thereto, those of ordinary skill in the art will understand that many other modifications can be made to the invention within the scope of the claims that follow. Accordingly, it is not intended that the scope of the invention in any way be limited by the above description, but instead be determined entirely by reference to the claims that follow.

The invention in which an exclusive right is claimed is defined by the following:

1. Apparatus adapted to be used with an item of footwear for supporting and stabilizing a portion of a user's foot in order to reduce a risk of injury from occurring, or reoccurring, or an injury already sustained from being exacerbated, during a pathological motion of a user's foot, comprising:

(a) a support foundation configured to be removably fastened to a leg of the user, at a point above an ankle of the user; and (b) at least one tension band configured to engage the support foundation, and to engage at item of footwear, said at least one tension band including at least one of the following:

(i) a first lateral tension band having a distal end and a proximal end, the distal end being configured to engage an item of footwear when the apparatus is worn by a user, the proximal end being coupled to the support foundation at a location proximate a central portion of the support foundation, such that when the apparatus is worn by a user, said central portion is substantially aligned with a user's ankle and the location is at least one of substantially aligned with a user's ankle and anterior to a user's ankle, the first lateral tension band extending downwardly beyond the support foundation, such that an acute angle is formed between the first lateral tension band and the support foundation; and (ii) a first medial tension band having a distal end and a proximal end, the distal end being configured to engage an item of footwear when the apparatus is worn by a user, the proximal end being coupled to the support foundation at a location proximate the central portion of the support foundation, such that when the apparatus is worn by a user, said central portion is substantially aligned with a user's ankle and the location is at least one of substantially aligned with a user's ankle and anterior to a user's ankle, the first medial tension band extending downwardly beyond the support foundation, such that an acute angle is formed between the first medial tension band and the support foundation, such that when the user's foot is properly positioned in an item of footwear worn during use of the apparatus, and the first medial tension band is tensioned to a desired tension, the first medial tension band is disposed adjacent to a navicular tuberosity of the user's foot, thereby supporting and stabilizing the user's foot.

2. The apparatus of claim 1, further including at least one of:

(a) a second lateral tension band configured to engage the support foundation, and to engage an item of footwear at a third location disposed on an item of footwear substantially proximate to a lateral heel counter of an item of footwear worn during use of the apparatus, such that the second tension band supports and stabilizes the user's foot by limiting lateral frontal plane motion and external rotation traverse plane motion to avoid an injury, a reoccurrence of injury, or exacerbating an existing injury of a user, the second tension band being responsible for a majority of the support and stabilization of the user's foot provided by the apparatus when the user's foot is properly positioned in an item of footwear worn during use of the apparatus, and the second lateral tension band is tensioned to a desired tension, and the user's foot is in a neutral position; and (b) a second medial tension band configured to engage the support foundation, and to engage an item of footwear at a fourth location disposed on the item of footwear substantially proximate to a medial heel counter of an item of footwear worn during use of the apparatus, the second medial tension band reducing a risk of injury, reoccurrence of an injury, or exacerbating an existing injury due to eversion when the user's foot is properly positioned in an item of footwear worn during use of the apparatus, and the second medial tension band is tensioned to a desired tension.

3. The apparatus of claim 2, wherein a tension of each tension band is readily adjustable by a user to achieve the desired tension for the tension band.

4. The apparatus of claim 3, further comprising an attachment member corresponding to each tension band, each attachment member being configured to be disposed on an item of footwear worn during use of the apparatus, at the location at which its corresponding tension band engages an item of footwear worn during use of the apparatus, each attachment member being configured to slidingly engage its corresponding tension band, such that when the apparatus is properly adjusted, a first end of each tension band engages the support foundation, each tension band extending from the support foundation to its corresponding attachment member, each tension band slidingly engages its corresponding attachment member, each tension band extending from its corresponding attachment member back to the support foundation, and a second portion of each tension band engaging at least one of the support foundation, a buckle disposed on that tension band, and a third portion of the tension band.

5. The apparatus of claim 4, wherein a tension associated with each tension band includes means for achieving the desired tension by at least one of:

(a) disengaging the second portion of the tension band from the support foundation, and selecting a different portion of the tension band to engage the support foundation;

(b) disengaging the second portion of the tension band from the buckle, and selecting a different portion of the tension band to engage the buckle; and (c) disengaging the second portion of the tension band from the support foundation, and selecting a different portion of the tension band to engage the third portion of the tension band.

6. The apparatus of claim 4, wherein the second portion of each tension band comprises one part of a hook and loop fastener, and one of the support foundation and the third portion of the tension band comprises the other part of the hook and loop fastener.

7. The apparatus of claim 4, further comprising an item of footwear, wherein each attachment member comprises at least one the following:

(a) a slot formed in the item of footwear;

(b) a grommet mounted in the item of footwear;

(c) a ring attached to the item of footwear; and (d) a fixture attached to the item of footwear and having an opening through which a tension band passes.

8. The apparatus of claim 7, wherein an attachment member for attaching to the first lateral tension band is attached to the item of footwear at a location adjacent to a base of a fifth metatarsal bone of the user's foot when the foot is properly positioned in the item of footwear and the apparatus is attached to the item of footwear.

9. The apparatus of claim 2, wherein when the second lateral tension band is attached to an item of footwear and is tensioned to the desired tension during use of the apparatus, the second lateral tension band is substantially perpendicular to a sole of an item of footwear worn during use of the apparatus.

10. The apparatus of claim 1, wherein when the first lateral tension band is attached to an item of footwear and is tensioned to the desired tension during use of the apparatus, an acute angle is formed between the first lateral tension band and a sole of an item of footwear, closest to a heel of an item of footwear worn during use of the apparatus.

11. The apparatus of claim 1, wherein the first lateral tension band is movably attached to the support foundation, such that the apparatus is usable with different size items of footwear.

12. The apparatus of claim 1, wherein the first medial tension band is movably attached to the support foundation, such that the apparatus is usable with different size items of footwear.

13. The apparatus of claim 1, wherein the support foundation comprises an ankle collar.

14. The apparatus of claim 13, wherein the ankle collar is removably attached to a user's leg using a hook and loop fastener.

15. The apparatus of claim 13, wherein a first end of the ankle collar comprises a first portion and second portion, the first portion being configured to removably attach the ankle collar to the user's leg proximate the user's ankle, and the second portion being configured to secure each tension band to the ankle collar, after the apparatus is adjusted and each tension band is tensioned to the desired tension for that tension band.

16. The apparatus of claim 1, wherein said at least one tension band is pivotally attached to the support foundation.

17. The apparatus of claim 1, wherein each tension band comprises one of:

(a) a textile strap; and (b) a generally non-elastomeric material.

18. Apparatus adapted to be used with an item of footwear for supporting and stabilizing a portion of a user's foot in order to reduce a risk of injury from occurring, reoccurring, or an existing injury from being exacerbated, during a pathological motion of the user's foot, comprising:

(a) a support foundation adapted to be removably fastened to a user's leg at a point above a user's ankle;

(b) a first tension band that engages the support foundation, and adapted to engage an item of footwear at a first location disposed on an item of footwear substantially proximate to a heel counter of an item of footwear worn during use of the apparatus, such that when a user's foot is properly positioned in an item of footwear worn during use of the apparatus and the first tension band is adjusted to a desired tension, the first tension band is substantially perpendicular to a sole of an item of footwear worn during use of the apparatus; and (c) a second tension band that engages the support foundation, and adapted to engage an item of footwear worn during use of the apparatus at a second location disposed on an item of footwear worn during use of the apparatus proximate to a front quarter of an item of footwear worn during use of the apparatus, the second location being closer to a vamp of an item of footwear than to the heel counter of an item of footwear worn during use of the apparatus, so that when a user's foot is properly positioned in an item of footwear and the second tension band is tensioned to a desired tension, an acute angle is formed between the second tension band and the sole of an item of footwear worn during use of the apparatus, at a side of the second tension band that is closer to the first tension band, and the second tension band does not overlap an intermediate portion of the first tension band, said intermediate portion being disposed between the support foundation and the first location.

19. The apparatus of claim 18, wherein the first location is on a lateral side of an item of footwear worn during use of the apparatus, such that when the user's foot is properly positioned in an item of footwear worn during use of the apparatus and the first tension band is tensioned to the desired tension, the first tension band substantially reduces a risk of injury, a reoccurrence of an injury, or an exacerbation of an existing injury due to inversion.

20. The apparatus of claim 18, wherein the first location is on a medial side of an item of footwear worn during use of the apparatus, such that when the user's foot is properly positioned in an item of footwear worn during use of the apparatus and the first tension band is tensioned to the desired tension, the first tension band overlaps at least a portion of a posterior tibial tendon of the user's foot, thereby supporting and stabilizing the user's foot.

21. The apparatus of claim 18, wherein the second location is proximate a medial quarter of an item of footwear worn during use of the apparatus, such that when the user's foot is properly positioned in an item of footwear worn during use of the apparatus and the second tension band is tensioned to the desired tension, the second tension band is disposed adjacent to a navicular tuberosity of the user's foot, thereby supporting and stabilizing the user's foot.

22. The apparatus of claim 18, wherein the second location is proximate a lateral quarter of an item of footwear worn during use of the apparatus, such that when the user's foot is properly positioned in an item of footwear worn during use of the apparatus and the second tension band is tensioned to the desired tension, the second tension band is disposed adjacent to a base of a fifth metatarsal bone of the user's foot, thereby supporting and stabilizing the user's foot, particularly when the user's foot is in a plantarflexed position.

23. The apparatus of claim 18, further comprising an additional tension band, the additional tension band engaging the support foundation, and being adapted to engage an item of footwear worn during use of the apparatus at a third location proximate a heel quarter of an item of footwear worn during use of the apparatus, such that:

(a) when the first location is on a lateral side of an item of footwear worn during use of the apparatus, the third location is on a medial side of an item of footwear worn during use of the apparatus; and (b) when the first location is on the medial side of an item of footwear worn during use of the apparatus, the third location is on the lateral side of an item of footwear worn during use of the apparatus.

24. The apparatus of claim 18, further comprising an additional tension band, the additional tension band engaging the support foundation, and being adapted to engage an item of footwear worn during use of the apparatus at a third location proximate a front quarter of an item of footwear worn during use of the apparatus, such that:

(a) when the second location is on a lateral side of an item of footwear worn during use of the apparatus, the third location is on a medial side of an item of footwear worn during use of the apparatus; and (b) when the second location is on the medial side of an item of footwear worn during use of the apparatus, the third location is on the lateral side of an item of footwear worn during use of the apparatus.

25. The apparatus of claim 18, further comprising an item of footwear, said item of footwear including an attachment member for connecting to each tension band, each attachment member being disposed on the item of footwear at the location at which one of the tension bands engages the item of footwear, each attachment member being configured to slidingly engage the tension band to which it connects, such that when the tension bands are tensioned to the desired tensions, a first end of each tension band engages the support foundation, each tension band extends from the support foundation to the attachment member to which it is connected, slidingly engages the attachment member, and extends back to the support foundation, a second portion of each tension band engaging at least one of the support foundation, a buckle disposed on the tension band, and a third portion of the tension band.

26. A method for supporting and stabilizing a portion of a user's foot in order to reduce a risk of injury, a reoccurrence of an injury, or an exacerbation of an existing injury from occurring, during a pathological motion of the user's foot, comprising the steps of:

(a) attaching a support foundation to the user's leg, adjacent to the user's ankle malleoli; and (b) positioning a first tension band such that the first tension band engages both the support foundation and an item of footwear at one of the following locations:

(i) a first location disposed on the item of footwear proximate to a lateral quarter of the item of footwear, such that when tensioned to a desired tension, the first tension band supports and stabilizes the user's foot, particularly when the user's foot is in a plantarflexed position; and (ii) a second location disposed on the item of footwear proximate to a medial quarter of the item of footwear, such that when the user's foot is properly positioned in the item of footwear and the first tension band is tensioned to a desired tension, the first tension band is disposed adjacent to a navicular tuberosity of the user's foot, thereby supporting and stabilizing the user's foot.

27. The method of claim 26, further comprising the step of positioning a second tension band and tensioning the second tension band to a desired tension, such that the second tension band engages both the support foundation and the item of footwear at one of the following locations on the item of footwear:

(a) a third location disposed on the item of footwear proximate to a lateral heel counter of the item of footwear, such that the second tension band supports and stabilizes the user's foot, particularly when the user's foot is in both a neutral position and a dorsiflexed position; and (b) a fourth location disposed on the item of footwear proximate to a medial heel counter of the item of footwear, such that the second tension band is disposed adjacent to a posterior tibial tendon.

28. The method of claim 26, further comprising the step of adjusting the first tension band to the desired tension selected to achieve a desired degree of support.

29. The method of claim 28, wherein a first end of the first tension band is attached to the support foundation and the first tension band slidingly engages the item of footwear at one of the first and second locations, and the step of adjusting the first tension band to the desired tension comprises the steps of:

(a) pulling a second end of the first tension band generally away from the respective one of the first and second locations, and generally toward the support foundation until the desired tension is loaded; and (b) securing the first tension band so as to maintain the desired tension.

30. The method of claim 29, wherein the step of securing the first tension band comprises the step of attaching the second end of the first tension band to the support foundation.

31. The method of claim 29, wherein the step of securing the first tension band comprises the step of attaching the second end of the first tension band to a portion of the first tension band disposed between the support foundation and the respective one of the first and second locations.

32. The method of claim 29, wherein the step of securing the first tension band comprises the step of passing the first tension band through a buckle.

33. A method for supporting and stabilizing a portion of a user's foot in order to reduce a risk of injury, or a reoccurrence of an injury, or an exacerbation of an existing injury from occurring, during a pathological motion of the user's foot, comprising the steps of:

(a) coupling a first attachment member to a lateral heel counter of an item of footwear;

(b) coupling a second attachment member to a lateral quarter of the item of footwear;

(c) removably coupling a support foundation to the user's leg at a point above the user's ankle;

(d) coupling a first tension band to the support foundation;

(e) coupling a second tension band to the support foundation;

(f) engaging the first tension band with the first attachment member, to provide support when a user's foot is in a dorsiflexed position and a neutral position; and (g) engaging the second tension band with the second attachment member, to provide support when the user's foot is in a plantarflexed position.

34. The method of claim 33, further comprising the steps of:

(a) coupling a third attachment member to a medial heel counter of the item of footwear;

(b) coupling a third tension band to the support foundation; and (c) engaging the third tension band with the third attachment member, such that the third tension band is disposed adjacent to a posterior tibial tendon of the user's foot when the user's foot is properly positioned in the item of footwear to provide support for the user's foot.

35. The method of claim 33, further comprising the steps of:

(a) coupling a third attachment member to a medial quarter of an item of footwear;

(b) coupling a third tension band to the support foundation; and (c) engaging the third tension band with the third attachment member, such that the third tension band is disposed adjacent to a navicular tuberosity of the user's foot when the user's foot is properly positioned in the item of footwear, to provide support to the user's foot.

36. Apparatus adapted to be used with an item of footwear for supporting and stabilizing a portion of a user's foot in order to reduce a risk of injury from occurring, or reoccurring, or an injury already sustained from being exacerbated, during a pathological motion of a user's foot, comprising:

(a) a support foundation configured to be removably fastened to a leg of the user, at a point above an ankle of the user; and (b) a tension band having a distal end and a proximal end, the distal end being configured to engage an item of footwear when the apparatus is worn by a user, the proximal end being coupled to the support foundation at a location proximate a central portion of the support foundation, such that when the apparatus is worn by a user, said central portion is substantially aligned with a user's ankle, and the location is at least one of substantially aligned with a user's ankle and anterior to a user's ankle, the tension band extending downwardly beyond the support foundation, such that an acute angle is formed between the tension band and the support foundation.

37. The apparatus of claim 36, wherein the tension band comprises a lateral tension band configured to engage an item of footwear at a second location selected to enable the lateral tension band to provide support to a user's forefoot in a plantarflexed position.

38. The apparatus of claim 36, wherein the tension band comprises a medial tension band configured to engage an item of footwear at a second location selected to enable a portion of the first medial tension band to provide support to a posterior tibial tendon adjacent a navicular tuberosity of a user's foot.

39. Apparatus adapted to be used with an item of footwear for supporting and stabilizing a portion of a user's foot in order to reduce a risk of injury from occurring, reoccurring, or an existing injury from being exacerbated, during a pathological motion of the user's foot, comprising:

(a) a support foundation adapted to be removably fastened to a user's leg at a point above a user's ankle;

(b) a first tension band having a distal end and a proximal end, the distal end of the first tension band being configured to engage an item of footwear when the apparatus is worn by a user, the proximal end of the first tension band being coupled to the support foundation at a first location proximate a central portion of the support foundation, such that when the apparatus is worn by a user, said central portion is substantially above a user's ankle, and the first location is at least one of substantially aligned with a user's ankle and anterior to a user's ankle, the first tension band extending downwardly beyond the support foundation, such that a substantially right angle is formed between the first tension band and the support foundation; and (c) a second tension band having a distal end and a proximal end, the distal end of the second tension band being configured to engage an item of footwear when the apparatus is worn by a user, the proximal end of the second tension band being coupled to the support foundation at a second location proximate a central portion of the support foundation, such that when the apparatus is worn by a user, the second location is at least one of substantially aligned with a user's ankle and anterior to a user's ankle, the second tension band extending downwardly beyond the support foundation, such that an acute angle is formed between the second tension band and the support foundation.

* * * * *

UNITED STATES PATENT AND TRADEMARK OFFICE

CERTIFICATE OF CORRECTION

PATENT NO. : 7,171,766 B2
APPLICATION NO. : 10/799449
DATED : February 6, 2007
INVENTOR(S) : Bouché et al.

It is certified that error appears in the above-identified patent and that said Letters Patent is hereby corrected as shown below:

On the Title Page, Item (57)

| | |
|---|---|
| Abstract, line 1 | "A" should read --An-- |
| Column 2, line 64 | after "but" delete "also" |
| Column 3, line 3 | "a" should read --an-- |
| Column 3, line 52 | "and or" should read --and/or-- |
| Column 7, line 20 | "users" should read --user's-- |
| Column 13, line 8 | after "the" (second occurence) delete "an" |
| Column 14, line 17 | "at" should read --an-- |
| Column 14, line 63 | "traverse" should read --transverse-- |
| Column 15, line 58 | after "one" insert therefor --of-- |

Signed and Sealed this

Twenty-second Day of May, 2007

JON W. DUDAS
*Director of the United States Patent and Trademark Office*